United States Patent [19]

Chang

[11] Patent Number: 5,032,846

[45] Date of Patent: Jul. 16, 1991

[54] SELECTIVELY POSITIONABLE ANTENNA MOUNTING

[76] Inventor: Yu-Pin Chang, No. 19, Lane 772, Hoping Road, Taoyuan, Da Nan, Taoyuon, Taiwan

[21] Appl. No.: 403,190

[22] Filed: Sep. 5, 1989

[51] Int. Cl.[5] ..... H01Q 1/12

[52] U.S. Cl. ..... 343/882; 343/715; 343/888

[58] Field of Search ..... 343/715, 878, 880, 882, 343/900, 888

[56] References Cited

U.S. PATENT DOCUMENTS

| | | | |
|---|---|---|---|
| 3,304,037 | 2/1967 | Candela | 343/882 |
| 4,074,271 | 2/1978 | Sakuma | 343/715 |
| 4,115,779 | 9/1978 | Dantzler et al. | 343/715 |
| 4,785,305 | 11/1988 | Shyu | 343/715 |
| 4,882,592 | 11/1989 | Studer et al. | 343/715 |
| 4,916,456 | 4/1990 | Shyu | 343/715 |

FOREIGN PATENT DOCUMENTS

| | | | |
|---|---|---|---|
| 2708594 | 8/1978 | Fed. Rep. of Germany | 343/715 |
| 2900269 | 7/1979 | Fed. Rep. of Germany | 343/715 |
| 1332513 | 6/1963 | France | 343/715 |

*Primary Examiner*—Michael C. Wimer

*Attorney, Agent, or Firm*—Bullwinkel Partners, Ltd.

[57] ABSTRACT

An antenna mounting for mobile and portable radios with an antenna element which can be quickly and easily removed, replaced, or secured in selectable positions manually without hand tools. The antenna is received and supported by a manually rotatable setscrew which engages a complementary threaded opening in a selectively positionable arm assembly. The arm assembly is pivotally attached to a fixed vertical support perpendicular to the antenna mounting base. The pivoted arm allows the antenna setscrew's bottom tip to be selectively positioned and secured relative to indentations along the arcuate surface of a semicircular shaped structure on the vertical support. The antenna may be physically removed for safekeeping by reversing the aforementioned procedure.

4 Claims, 1 Drawing Sheet

SELECTIVELY POSITIONABLE ANTENNA MOUNTING

TECHNICAL FIELD

This invention relates generally to antenna mountings, and more particularly to mobile and portable antenna mountings which can be secured in selectable positions without the use of tools.

BACKGROUND OF THE INVENTION

The increasing public uses of mobile and portable cellular telephones, telephone facsimile machines, and television systems create a need for inexpensive, reliable, and multi-positional external antennas. Operators of such diverse equipment have various work and security requirements involving antenna mountings. A major requirement is that an operator at anytime should be able to quickly and easily remove, replace, or secure an antenna in selectable positions using hands only. Another important requirement is that a secured antenna should not become unsecured due to normal operating conditions or environmental forces.

Previous types of mobile and portable mountings required the use of hand tools to perform the steps of removing, replacing, or securing the antennas. The tools used were screwdrivers, wrenches, or pliers. Under actual working conditions one or more steps requiring tools could not be performed quickly, if at all, by men or women. For example, a radio antenna with its upper segment projecting above a vehicle's highest metal roof plane generally results in superior receiving and transmitting performance.

Therefore, a popular type of antenna mounting was attached by adhesive on the uppermost and center position of a vehicle's front or rear window. That location made it difficult, or impossible, for a man or woman of average height to stand on the ground and use hand tools on the antenna. Additionally, the operator may be in a position or location where he has no access to any hand tools.

Antennas can become unsecured due to external environmental forces against the antennas, and internal movements in the mountings when subjected to shock and vibrations. These factors cause flexing and twisting of the antenna element which transmits torque to its base connection on the mounting. Previous devices typically use an antenna element with a threaded base stem and lock washer or nut, which is screwed into a socket assembly pivoted on a bolt or set of screws in the mounting. These parts require tightening with tools since hand tightening is inadequate.

SUMMARY OF THE INVENTION

It is an object of the present invention to manually without tools secure in a selectable position the antenna element to its mounting.

Another object of the present invention is to provide a mounting which can secure the antenna element in a selected position despite torque in the antenna element from external environmental forces and movements and vibrations in the mounting.

A further object of the present invention is to provide a certain number of precise antenna positions any one of which can be quickly and easily selected by the operator at anytime even under adverse external environmental conditions.

The present invention includes an antenna element which can be manually secured to an arm pivotally attached to a vertical support on the mounting. The antenna element is held in place by friction fit in an opening and the pivoted arm allows the antenna's lower stem and bottom tip to be positioned just above an arcuate surface of the mounting at any point along a plane perpendicular to the axis of the pivot. A certain number of protrusions or indentations are formed along the surface which can receive the bottom tip. The antenna element can be lowered causing its bottom tip to enter and become tightly wedged between complementary shaped walls of a selected indentation. Friction due to a compression fit between the walls and the bottom tip prevents the antenna from auto-rotating. Also, additional friction from the fit between the antenna and the opening of the pivoted arm prevents the bottom tip from moving upward or out of the indentation. Consequently the antenna becomes fixed in a certain angular position in relation to the base of the mounting. Manual action can be used to remove the antenna by reversing the aforementioned procedure.

The foregoing and additional objects, features and advantages of the present invention will be more readily apparent from the following detailed description of a preferred embodiment thereof, which proceeds with reference to the accompanying drawings.

DESCRIPTION OF THE PREFERRED EMBODIMENT

Figure 1:
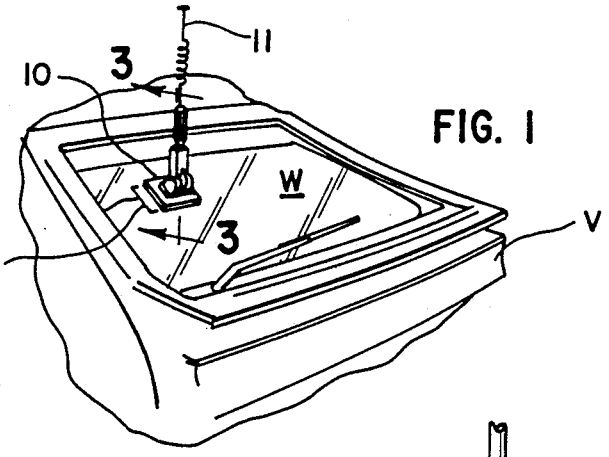
FIG. 1 is a perspective view of an antenna with mounting base of this invention attached to the rear window of an automobile.
Figure 2:
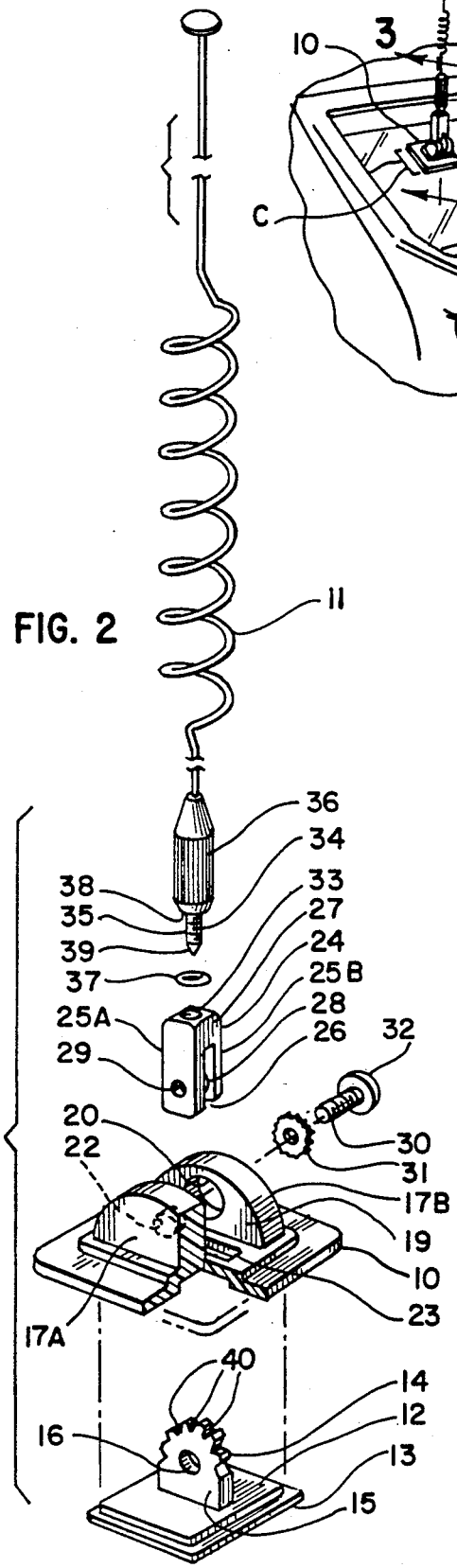
FIG. 2 is a perspective view of the disassembled antenna and pivoted means and pivot assembly and the mounting base of FIG. 1.
Figure 3:
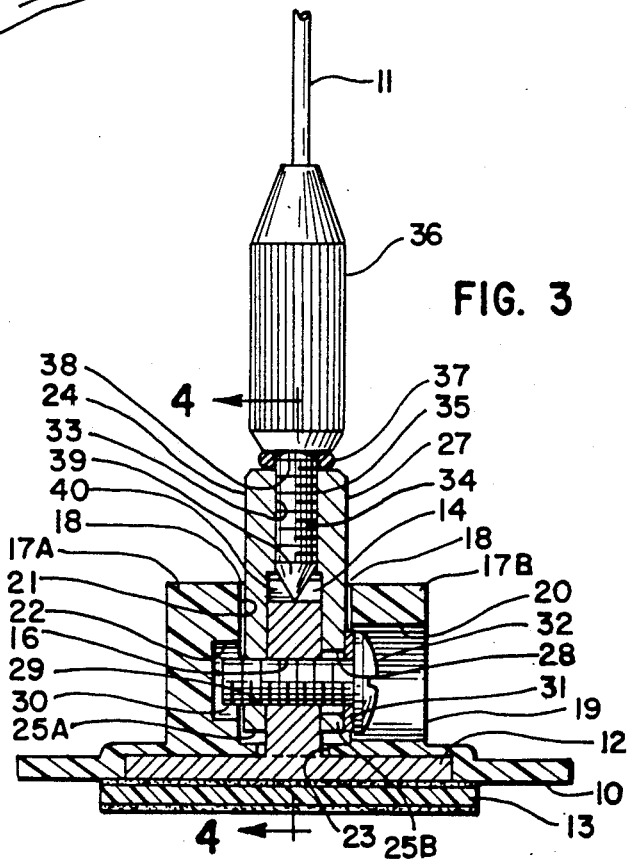
FIG. 3 is a sectional view along a plane indicated by section line 3—3 in FIG. 1.
Figure 4:
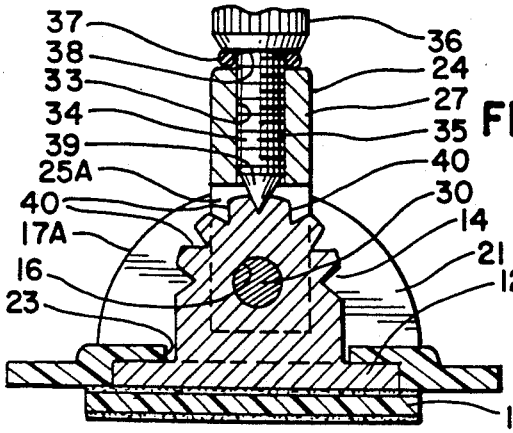
FIG. 4 is a sectional view along a plane indicated by section line 4—4 in FIG. 3.

Referring to the figures of the drawings in the embodiment shown, the reference numeral 10 indicates generally the antenna mounting attached to the rear window W, of a vehicle V. The mounting includes means to secure antenna element 11 in a selectable angular position in relation to the mounting base as shown in FIG. 1. External environmental factors and movements of the base cause antenna torque which is effectively dampened by the mounting.

Mounting means 10 include a metal base plate 12 attached to the upper side of a flexible adhesive patch 13 which has its underside attached to the external surface of rear window W. A flexible sealant is applied around the perimeter of patch 13 between the external surface of rear window W and underside plastic edges of the base of mounting 10. The metal base plate 12 serves as a capacitor element in coupling relationship with a capacitor member C (FIG. 1) which may be attached directly opposite on the internal surface of rear window W and connected to circuitry for receiving and transmitting radio frequency energy. Base plate 12 is preferably a metal casting with an integral generally semi-circular support element 14 having its flat edge generally parallel to the base plate 12 and a curved edge with indented arcuate surface extending upward and perpendicular to base plate 12 and having upstanding parallel walls 15 which define a cylindrical bore 16. The center point of bore 16 is generally equidistant from arcuate surface points defining the semi-circular configuration of support element 14.

Two parallel plastic shield members 17A and 17B are perpendicular to mounting 10 of which they are integral parts. The shield members are spaced apart a measured distance 18. The wall 19 of shield member 17B includes a cylindrical bore 20, and the wall 21 of shield member 17A includes a cylindrical recess 22. Bore 20 and recess 22 are co-axial in opposed alignment. In the embodiment of FIGS. 1–4, mounting 10 and shield members 17A and 17B are formed of a weather resistant nonconductive integral plastic, with a molded-in rectangular opening 23 to accommodate support element member 14.

A metal clevis 24 for conducting radio frequency energy is formed with two generally parallel leg members 25A and 25B spaced apart a measured distance 26, and extending downwardly from an integral transverse shoulder member 27. The leg member 25B includes a cylindrical bore 28 in coaxial alignment with a cylindrical threaded bore 29 in leg member 25A. Leg members 25A and 25B are assembled in a sliding fit against the sides of support element 14.

A metal screw 30, with locking washer 31 positioned next to the screw head 32, passes through bore 20 of shield member 17B and bore 28 of leg member 25B, and bore 16 of support element 14. The screw 30 is rotated into corresponding threaded bore 29 of leg member 25A whereby leg members 25A and 25B are drawn together in an adjustable friction fit against the walls 15 of support element 14, thereby preventing clevis 24 from changing its angular position about screw 30 until manual force is applied.

An arm 27 in the form of a clevis shoulder member includes a threaded bore segment 33 to receive complementary threads 34 on antenna setscrew 35 and is pivotally attached by screw 32 to support element 14. Manual action is sufficient to rotate antenna knurled segment 36 causing it to descend towards shoulder member 27 until O-ring 37 of resilient plastic material is compressed firmly between arm 27 and bottom face 38. The compression friction fit on each side of O-ring 37 reaches its maximum level at the point when conical tip 39 descends into and becomes firmly wedged in one of the selectable indentations 40. The sides of conical bottom tip 39 are secured in place by compression friction fit with the walls of an indentation 40 additionally preventing antenna setscrew 35 from auto-rotating.

External environmental forces and antenna movements can create different torques in the antenna element 11 which are resisted by the described apparatus. A rotational torque to unscrew antenna setscrew 35 is resisted by friction between bottom face 38 and O-ring 37 and arm 27, in addition to compression friction fit between conical tip 39 and indentation 40. In the embodiment shown, torque that can move the upper part of antenna element 11 toward the front or rear of the vehicle is resisted by conical tip 39 secured in indentation 40 which prevents leg members 25A and 25B from rotating about screw 30. Torque that can move the upper part of antenna element 11 toward either side of the vehicle is resisted by leg members 25A and 25B which are pivotally fixed in place by screw 30 in cylindrical bore 16 of support element 14.

It should be apparent to those skilled in the art that there are many other combinations, variations and modifications possible all within meaning of these disclosures on the novel concepts of the present invention. Accordingly, I claim all such modifications as come within the scope and spirit of the following claims.

What I claim is:

1. A selectively positionable antenna mount comprising a base plate adapted to be secured to a mounting surface, a generally semi-circular support element having a flat edge and a curved edge defining an arcuate surface, with said flat edge generally parallel to said base plate and said arcuate surface extending perpendicular therefrom, said support element having a center point generally equidistant from all points on said arcuate surface, and said arcuate surface carrying a plurality of indentations disposed radially from its center point, an arm pivotally attached to said support element at the center point of the arcuate surface, said arm being selectively positionable in a plurality of desired angular locations along the arcuate surface, a manually removable antenna element with bottom tip received by said arm and being positionable therewith, and clamping means carried by said arm for mechanically engaging and securing said arm and antenna element to said support element in a desired angular position relative to the base plate, said means including a manually actuable setscrew receiving said antenna element, said setscrew being received in a threaded hole in said arm with said setscrew having a tip which is selectively engageable with at least one of said indentations to secure said arm in a desired angular position relative to said base plate.

2. The structure of claim 1 in which said setscrew has an annular shoulder spaced from said arm to define an annular channel when said setscrew is fully engaged with a selected indentation, and having resilient tensioning means in said annular channel for preventing unintended untightening of said setscrew.

3. The structure of claim 2 in which said resilient tensioning means is an elastomeric O-ring.

4. A selectively positionable antenna mount comprising a base plate adapted to be secured to a mounting surface, a generally semi-circular support element having a flat edge and a curved edge defining an arcuate surface, with its flat edge generally parallel to said base plate and its arcuate surface extending perpendicular thereto, the curved edge of said support element defining an arcuate surface having a plurality of indentations disposed radially from the center point of the arcuate surface, pivot means at the center point of said support element, a clevis rotatably supported on said support element by said pivot means, said clevis being selectively positionable in a plurality of angular locations along said arcuate surface and having a threaded through-hole which is radially alignable with a selected one of said indentations, a manually operable setscrew received in said clevis threaded through-hole, and having a tip which is selectively engageable with one of said indentations to secure the clevis in a desired angular position relative to the base plate, and an antenna element secured to the setscrew and being positionable therewith.

* * * * *